United States Patent [19]

Andrews

[11] Patent Number: 4,970,490

[45] Date of Patent: Nov. 13, 1990

[54] MOTOR BELL ALARM

[75] Inventor: Stephen W. Andrews, Oceanport, N.J.

[73] Assignee: Wheelock Inc., Long Branch, N.J.

[21] Appl. No.: 470,840

[22] Filed: Jan. 26, 1990

Related U.S. Application Data

[63] Continuation-in-part of Ser. No. 7,281,257, Dec. 7, 1988, abandoned.

[51] Int. Cl.[5] ..... G08B 3/00; G10K 1/064; G10K 1/00

[52] U.S. Cl. ..... 340/396; 340/392; 340/398; 340/402; 116/157; 116/159; 116/160

[58] Field of Search ..... 340/396, 392, 398, 402; 116/157, 159, 160

[56] References Cited

U.S. PATENT DOCUMENTS 4,153,898 5/1979 Larime ..... 340/396

4,286,259 8/1981 Ishii ..... 340/396

4,360,800 11/1982 Ishii ..... 340/396

*Primary Examiner*—Joseph A. Orsino

*Assistant Examiner*—Kinfe-Michael Negash

*Attorney, Agent, or Firm*—Brumbaugh, Graves, Donohue & Raymond

[57] ABSTRACT

A motor bell alarm comprises an electric motor and a linkage by which the rotational motion generated by an electric motor is translated to a longitudinal oscillating motion so as to cause a plunger coupled to the linkage to cyclically strike a shell, thereby creating a ringing sound. The volume and clarity of the ringing sound are enhanced by minimizing the time in which the plunger is in contact with the shell and by minimizing the rest mass that is in contact with the shell as it is struck by interposing a lost-motion connection between the plunger and the linkage to the electric motor, whereby upon and after striking the shell the plunger is mechanically uncoupled from the lever.

10 Claims, 8 Drawing Sheets

MOTOR BELL ALARM

BACKGROUND OF THE INVENTION

This application is a continuation-in-part of U.S. patent application Ser. No. 281,257, filed Dec. 7, 1988, now abandoned.

The present invention relates to a motor bell alarm in which the rotational motion of an electric motor is transduced to a longitudinal oscillating motion of a plunger for striking a bell shell, thereby creating a clear, loud ringing sound.

A conventional motor bell alarm is shown in FIG. 1. Conventional motor bell alarm designs use an electric motor 10 to generate a rotational motion at a motor shaft 12. This rotational motion is converted to a reciprocating motion by means of an eccentric cam 14 and a lever assembly 16 that link the motor shaft 12 to a plunger 18. The plunger 18, as a result of the reciprocating motion imparted to it by the cam-lever linkage, cyclically strikes a shell 20 to generate a ringing sound. The plunger 18 passes through and is guided in its longitudinal reciprocating motion by the alarm housing 22.

Inasmuch as the free vibration of the shell 20 is vital to the production of a clear, loud sound, it is important to minimize the time in which the striking plunger 18 is in contact with the shell 20. While the plunger 18 is in contact with the shell 20, the mass of the plunger 18 and other components in the plunger drive linkage dampens the vibrations of the shell, which, in turn, muffles the ringing sound. Ideally, the plunger 18 should strike the shell 20 at the apex of its reciprocating path and then instantaneously rebound towards its at-rest position.

In the prior art motor bell of FIG. 1 a resilient coil spring 24 is interposed between the lever assembly 16 and the plunger 18. The momentum imparted to the plunger 18 toward the shell 22 by the motion of the lever assembly 16 and the compression force of the spring 24 is such that the plunger overcomes the tension in the spring 24 to allow the plunger 18 to strike the shell 20 without the plunger 18 having to be pushed mechanically against the shell 20 by the lever assembly 16. As a result, the action of the plunger 18 striking the shell 20 more closely resembles an elastic collision. In other words, the plunger 18 rebounds off the shell 20 as a result of the collision. Without the spring 24, the plunger 18 would not rebound as a result of the collision but would instead retreat only after the reciprocating cycle reached its apex of motion toward the shell. By using the spring 24, the apex of the reciprocating cycle of the lever does not directly dictate when the plunger 18 retreats.

Although the spring 24 reduces the time that the plunger 18 is in contact with the shell 20, it does not minimize the rest mass in contact with the shell 20, and thus does not fully isolate the shell 20 from the dampening effect of the plunger 18. An object of the present invention, therefore, is to minimize the rest mass in contact with the shell 20, thereby further reducing the dampening effect on the shell 20 and enhancing the clarity and volume of the ringing sound. A further drawback to the use of a spring 24 in a conventional motor bell results from the spring 24 being an inefficient medium for transferring momentum to the plunger 18. Accordingly, another object of the present invention is to provide a more efficient means for imparting momentum to the plunger 18.

PRIOR ART

A motor bell alarm constructed generally in accordance with FIG. 1 is disclosed in U.S. Pat. No. 4,183,018. Other prior art motor bells are disclosed in U.S. Pat. Nos. 4,300,128, 4,305,066, 4,308,529, 4,310,834 and 4,368,458.

SUMMARY OF THE INVENTION

The present invention attains the foregoing and other objects by utilizing a linkage means that minimizes both the time of contact between the plunger and the shell and the magnitude of rest mass in contact with the shell while the shell is vibrating for generating the ringing sound. This is accomplished by use of a linkage that embodies a series of gaps between the various components, so that when the plunger strikes the shell it is not in driving contact with any other component. Furthermore, the present invention utilizes a drive arrangement that maximizes transfer of momentum to the plunger while still minimizing the collision time between the plunger and the shell. As the plunger rebounds from striking the shell, a gap exists either between the plunger and the pushrod or between the pushrod and the lever arm. As a result, the rest mass in contact with the vibrating shell is minimized, which in turn minimizes the dampening of the vibrations. Ultimately, such a characteristic leads to a clearer and louder ringing sound.

DESCRIPTION OF THE PREFERRED EMBODIMENTS

Figure 1:
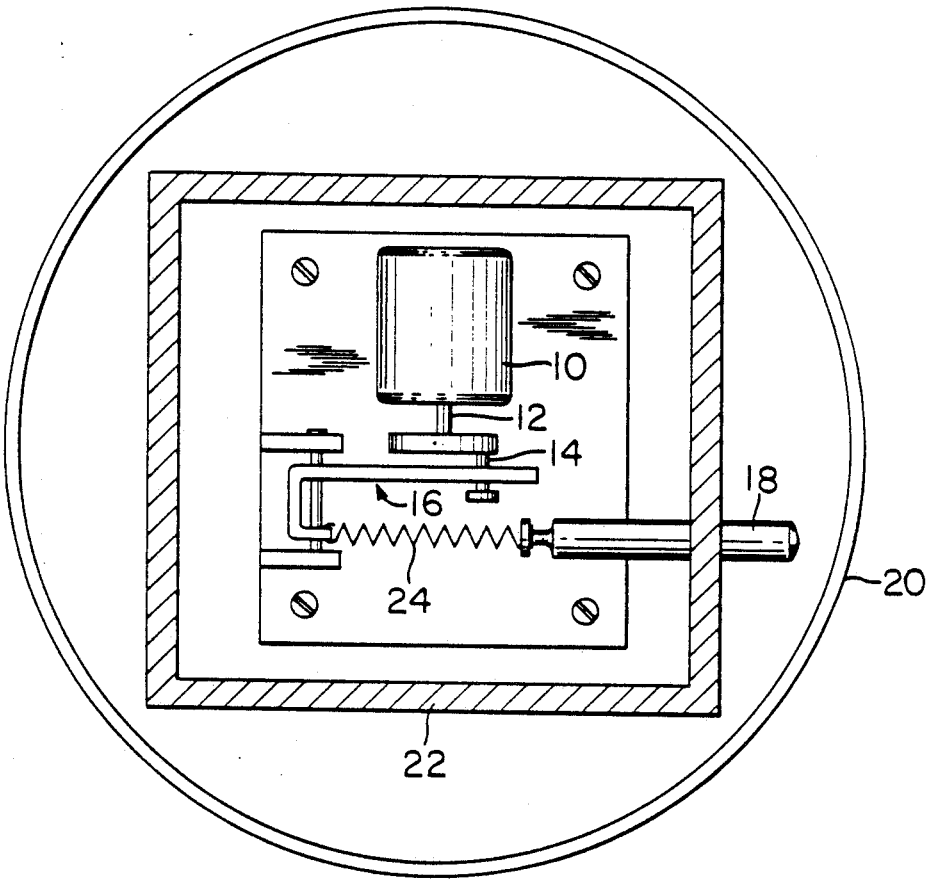
FIG. 1 (PRIOR ART)
FIG. 1 is a plan view of a conventional motor bell alarm.

In the embodiment of the invention shown in FIGS. 2–7, bolted to the base 26 of a metallic housing 28 are a plastic support member 30 and a metallic bell shell 32. Two electrical contacts 34, 36, a DC electric motor 38 and a lever arm assembly 40 are attached to various portions of the support member 30, as described more fully hereinafter. Each contact 34, 36 includes a thin metallic plate 42 affixed to the support member 30 by a metallic screw 44. Each screw 44 further functions as a means for clamping a wire (not shown) from an external power source (not shown) underneath each plate 42. The contacts 34, 36 are electrically connected to the DC motor 38 by wires 46, 48.

The electric motor 38 has at one end a protruding shaft 50 with an eccentric cam arrangement 52, including a circular cam plate 54 concentrically mounted on the shaft 50 and an off-centered cam pin 56. The off-centered pin 56 fits into an elongated slot 58 in one leg **40*a* of the lever arm assembly 40. As the shaft 50 rotates, the off-centered pin 56 has a circular motion that, because of its travel within the elongated slot 58, creates a back and forth oscillating or rocking motion of the lever arm leg 40*a* in the direction of the arrow 60 in FIGS. 3 and 4. The middle portion 40*b* of the lever arm assembly 40 joins the leg 40*a* at a right angle (FIG. 3 and 4), extends away from the motor 38, and is pivotally attached at its other end by pin 62 to an upstanding part 30*a* of the support member 36. A generally T-shaped leg 40*c* of the lever arm assembly 40 extends at a right angle to the pivoted end of the leg 40*b* and is pivoted by pin 64 at the other end of the cross bar of the T to a second upstanding part 30*b* of the support member 30. The lever arm assembly 40 is therefore free to pivot about the axis A—A formed by the two pins 62, 64 (preferably molded as part of the assembly 40) as the cam pin 56 urges the slotted leg 40*a* back and forth. The stem 40*d* of the T-shaped leg 40*c* extends upwardly (as seen in FIG. 4) from the pinned cross bar of the leg 40*c*, so that the motion at the upper free end 40*e* of the stem 40*d* is longitudinal, as indicated by the arrow 66. (See FIGS. 2 and 3**.)

Figure 7:
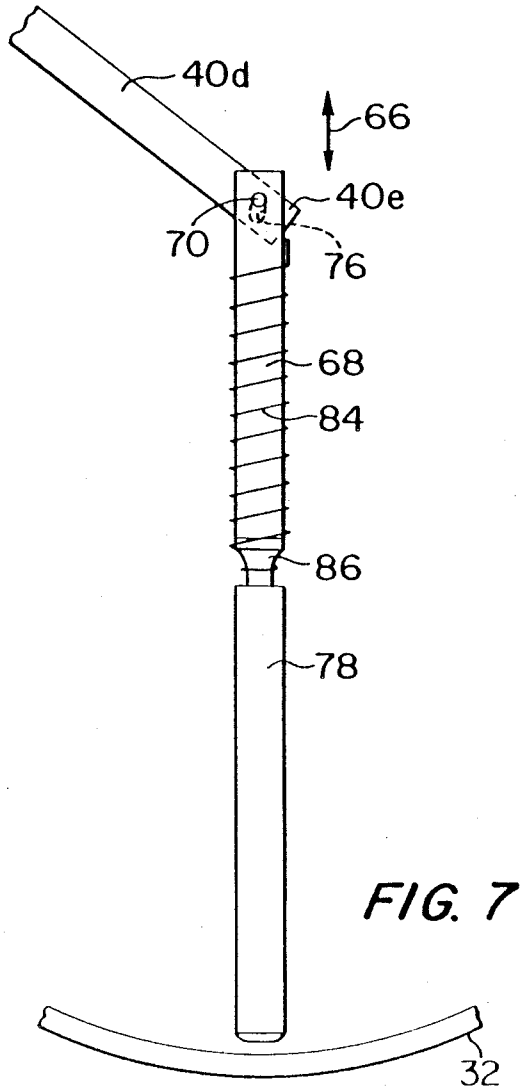
FIG. 7 shows the relative positions of the aforementioned component immediately after the plunger has struck the shell and has rebounded to contact the pushrod.
Figure 6:
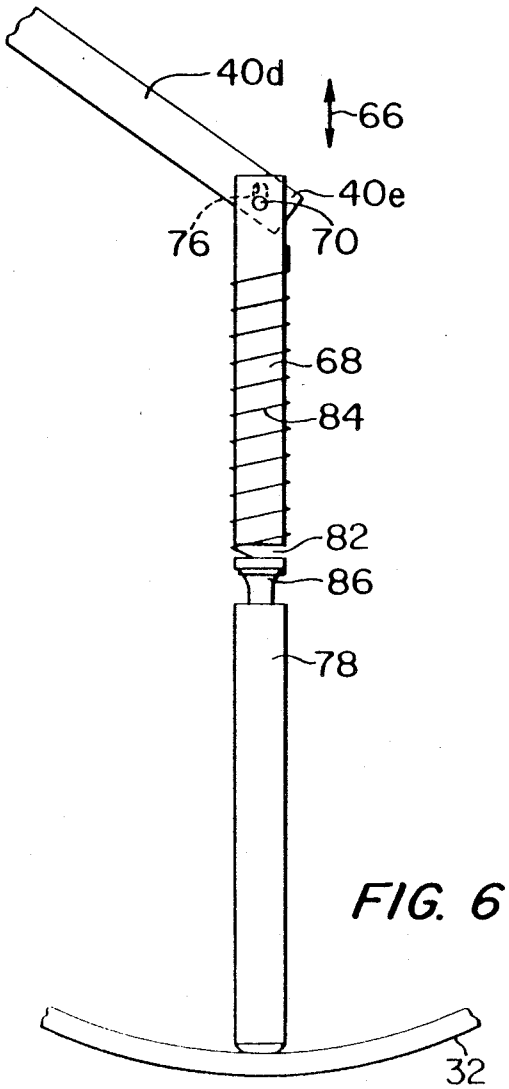
FIG. 6 shows the relative positions of the aforementioned components after the plunger has moved away from the pushrod to the shell.
Figure 5:
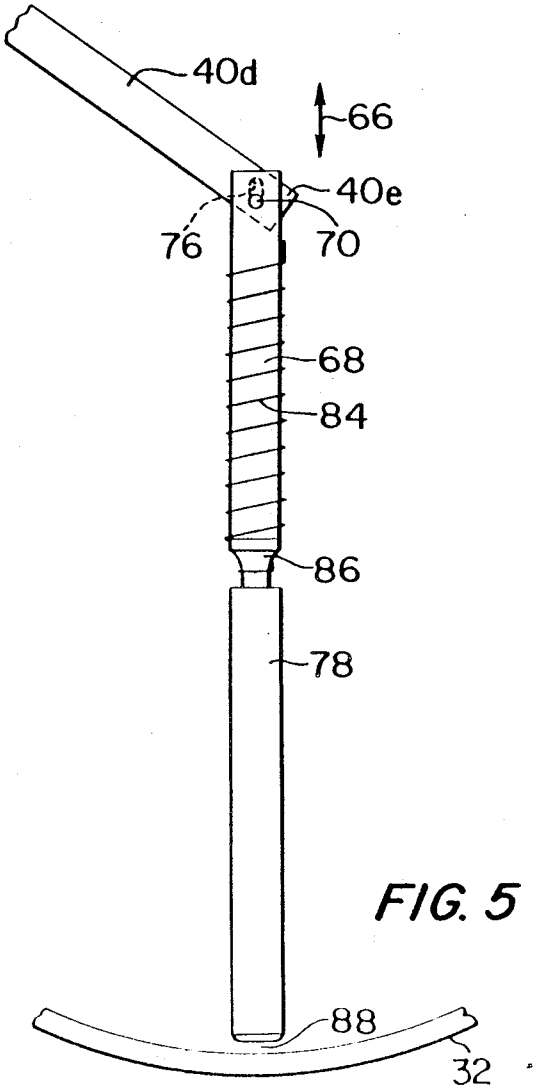
FIG. 5 shows the relative positions of the lever arm, pushrod, rebound spring, and plunger when the lever arm is at its farthermost position towards the shell but with the plunger still in contact with the pushrod.

With reference now to FIGS. 2, 3 and 5–7, the upper (as viewed in FIG. 3) free end **40*e* of the lever arm leg (stem) 40*d* is linked to a plastic pushrod 68 by a pin 70 that is inserted through a hole (not shown) in each side wall of a slot 74 in the pushrod and through an oversized hole 76 in the lever arm leg 40*d*. So assembled, the pushrod 68 is approximately perpendicular to the leg 40*d* of the lever arm assembly. The hole 76 in the leg 40*d* is significantly larger in the longitudinal direction than the diameter of the pin 70, as shown in FIGS. 5–7. This provides the pushrod 68 with a longitudinal freedom of movement, or lost-motion, so that as the lever arm leg 40*d* swings back and forth in the direction of the arrow 66 in FIG. 3, the pushrod 68 will not immediately follow. For example, as the lever arm leg 40*d* moves towards the shell 32, i.e., towards the left in FIG. 3 (or downward in FIGS. 5–7), the pushrod 68 will not move leftward until the pin 70 abuts the right-hand (top in FIGS. 5–7) edge of the hole 76 in the lever arm leg 40*d*. Continued downward movement of the leg 40*d* then urges the pushrod 68 and the metallic plunger 78, which the pushrod directly engages (FIG. 5), downward towards the shell 32. Eventually, all three components (leg 40*d*, pin 70 and pushrod 68) reach the apex of the downswing simultaneously. The momentum of the plunger 78, however, carries it farther downward until it strikes the shell 32. At that point, a gap 82 exists between the adjacent ends of the pushrod 68 and the plunger 78 (FIG. 6). The longitudinal movement of the plunger 78 is guided by aligned openings 79 and 81 in an upstanding part 30*c* of the support member 30 and in a plastic bushing 83 in the sidewall of the housing 28, respectively. (See FIG. 2 and 3**.)

When the plunger 78 rebounds, not only does the gap 82 close but the plunger 78 and pushrod 68 are free to move still farther away from the shell 32 because of the longitudinal play provided by the slot 76. This provides for the full natural rebound of the plunger 78 from the shell 32.

Figure 2:
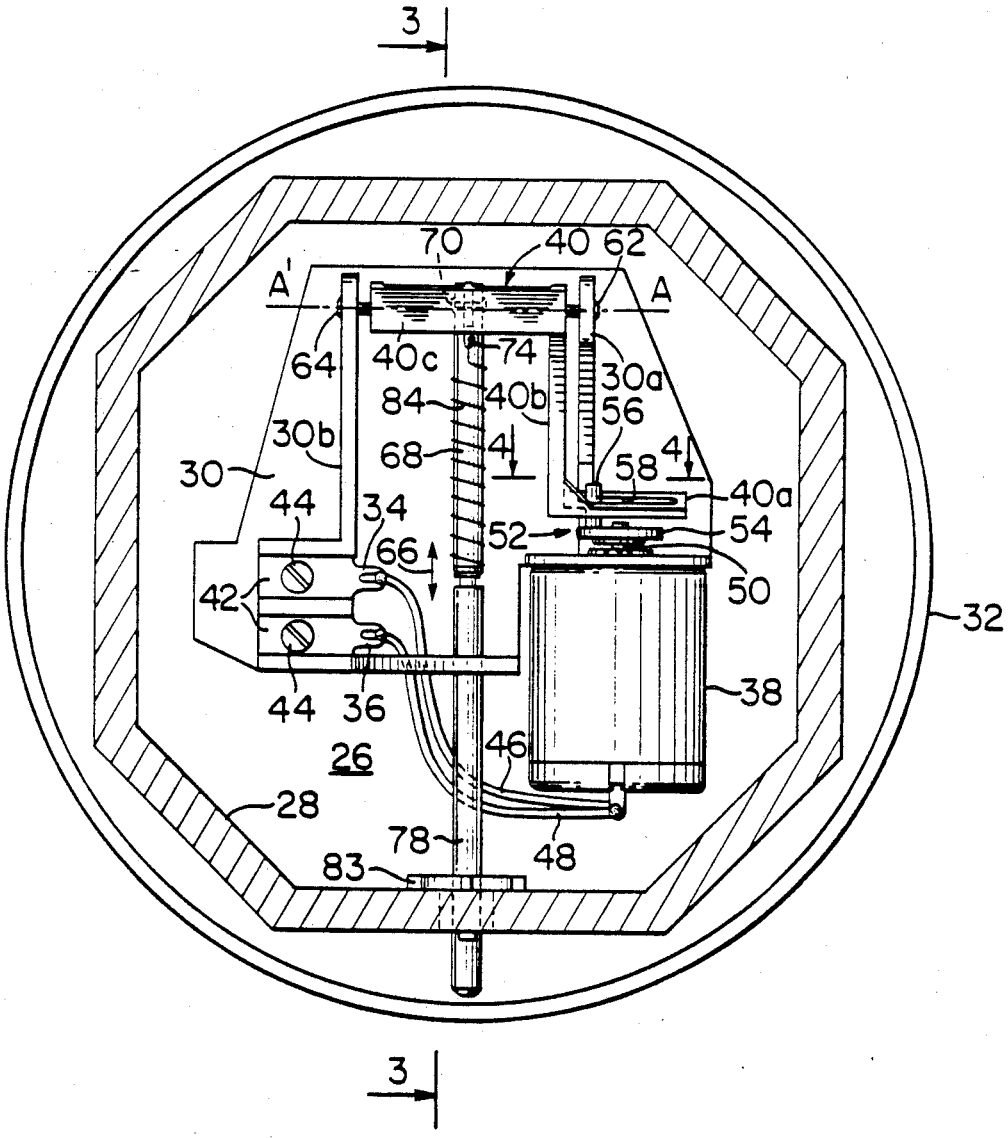
FIG. 2 is a plan view of one embodiment of the invention.
Figure 3:
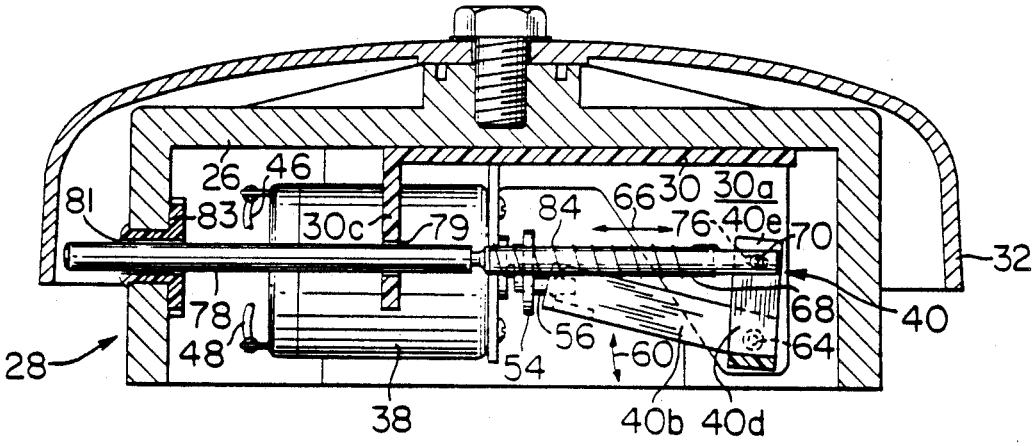
FIG. 3 is a sectional view of the embodiment of FIG. 2, taken along the line 3—3 in FIG. 2 and looking in the direction of the arrows.
Figure 4:
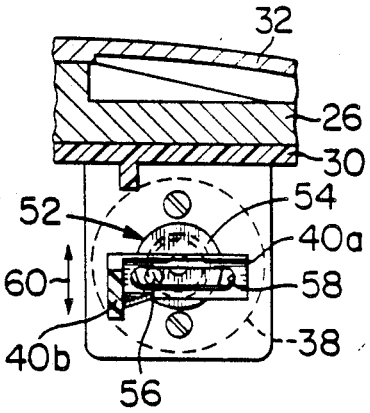
FIG. 4 is a partial sectional view taken along the line 4—4 in FIG. 3 and looking in the direction of the arrows, showing the driving connection between the cam wheel on the motor shaft and the slotted leg of the lever arm assembly.

The lever arm **40*d* then begins its swing away from the shell 32 (rightward in FIG. 3 and upward in FIGS. 6 and 7). Because the hole 76 is larger than the diameter of the pin 70, however, the lever arm leg 40*d* will not engage the pushrod 68 until the pin 70 bears against the lower edge of the hole 76 (FIG. 7). This effectively disconnects the lever arm assembly 40, cam arrangement 52 and electric motor 38 from the plunger 78 during the time of rebound of the plunger 78 from the shell 32. The slot 74 (FIG. 2) in the pushrod 68 must be long enough that the lever arm leg 40*d* will only be in contact with the pushrod 68 at the pin 70. In other words, the free end 40*e* of the lever arm leg 40*d* should not be in contact with the inner end of the slot 74 in the pushrod 68**. Otherwise, the pushrod's longitudinal freedom of movement would be restricted.

A tension coil spring 84 concentrically surrounds the pushrod 68 and is connected at one end to the pushrod 68 at the outer edge of the slot 74 (see FIG. 2). When the system is at rest (FIG. 5), the spring 84 pulls the plunger 78 toward the pushrod 68 such that the outer end of the pushrod 68 bears directly against the inner end of the plunger 78. The other end of the spring 84 is connected to the plunger 78, preferably by being wound around a flared flat-head stud portion 86 formed at the inner end of the plunger 78. The resiliency of the spring 84 is selected so that the momentum imparted to the plunger 78 by the pushrod 68 will be sufficient to cause the plunger 78 to move out of bearing engagement with the adjacent end of pushrod 68 (FIG. 6). This additional excursion of the plunger 78, therefore, extends beyond the position the plunger 78 would have reached had the plunger 78 been in continuous contact with the pushrod 68. With the added excursion, the plunger 78 can then strike the shell 32. When the plunger 78 is at-rest, a gap 88 exists between the plunger 78 and the shell 32 (FIG. 5).

Because the plunger 78 as it strikes the shell 32 is linked to the pushrod 68 only by the spring 84, the plunger 78 is free to rebound instantaneously from the shell 32. The spring 84, being under tension at that stage, actively aids in the rebound of the plunger 78. Accordingly, the time that the plunger 78 is in contact with the shell 32 is minimized.

Unlike the conventional motor bell of FIG. 1 which utilizes the coil spring 24 to store energy and impart momentum to the plunger 18, the present invention uses the coil spring 84 solely to regulate the gap 82 between the pushrod 68 and to aid in rebounding the plunger 78. In the present invention, the pushrod 68 directly imparts momentum to the plunger 78. This arrangement results in a more efficient transfer of momentum while still minimizing the time that the plunger 78 and the shell 32 are in contact. Accordingly, a louder, clearer ringing sound results.

As a result of the longitudinal freedom (lostmotion) between the leg 40*d* and the pushrod 68, all components except the pushrod 68 (which, through the spring 84, is still connected to the plunger 78) of the motor bell are isolated from the rebounding plunger 78. This is illustrated in FIG. 6. This minimizes the rest mass that acts to dampen vibration of the shell 32. The mass of the plastic pushrod 68 is significantly less that the mass of the metal plunger 78, thereby reducing any dampening effect resulting from the linkage of the pushrod 68 to the plunger 78. Consequently, the motor bell generates a clearer and louder ringing sound.

Figure 8:
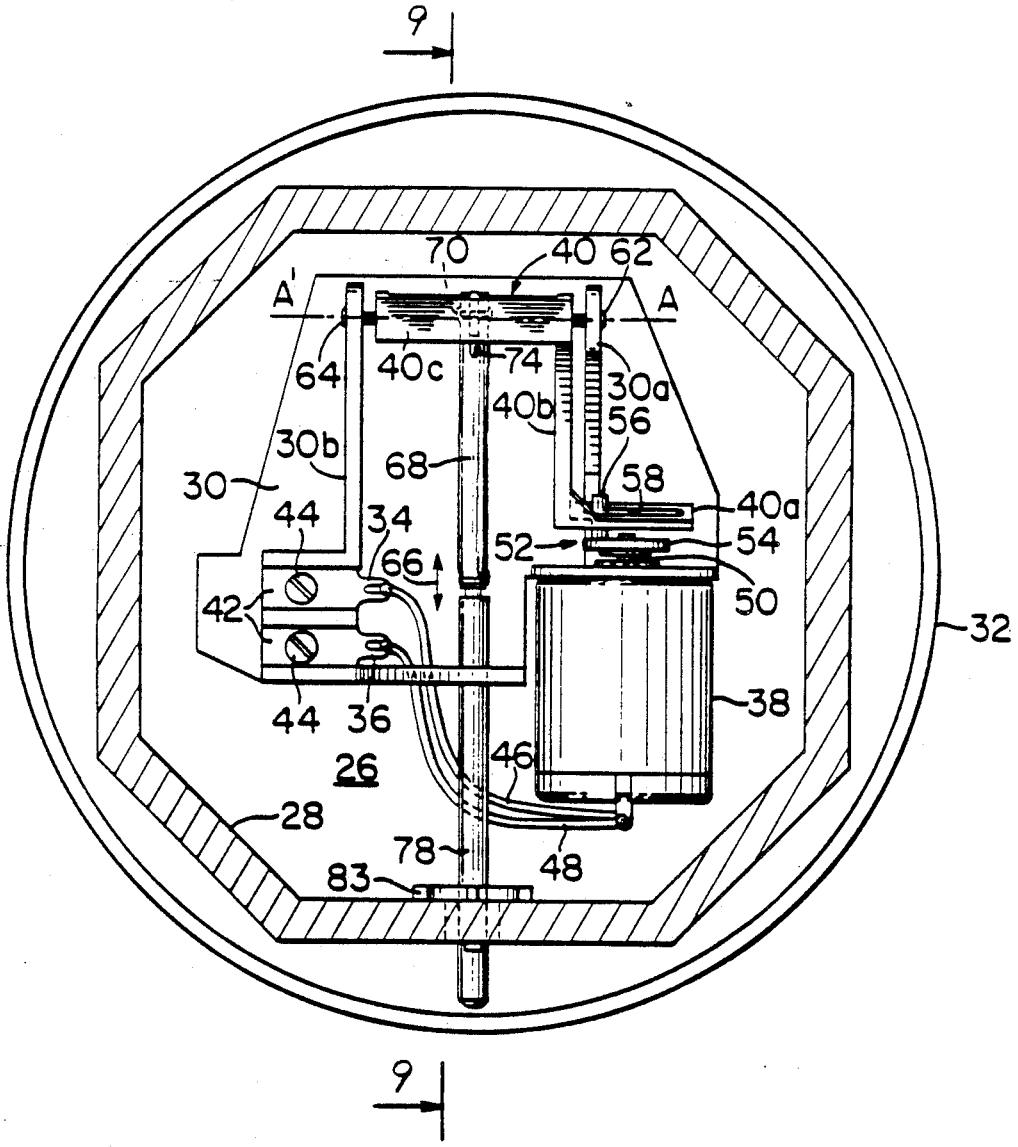
FIG. 8 is a plan view of a second embodiment of the invention.
Figure 9:
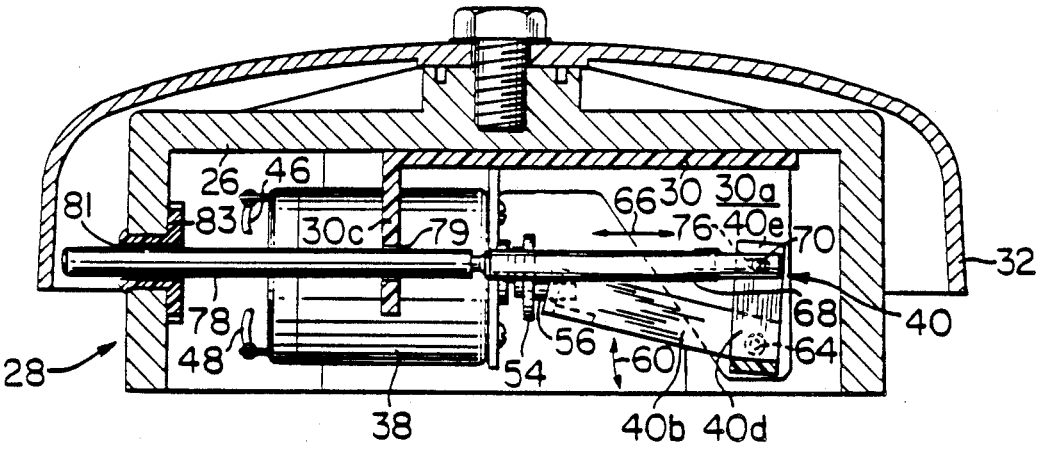
FIG. 9 is a sectional view of the embodiment of FIG. 8, taken along the line 9—9 in FIG. 8 and looking in the direction of the arrows.

In a second embodiment, illustrated in FIGS. 8 and 9, the pushrod 68 and the plunger 78 are rigidly connected by glue or some other means. This embodiment does not utilize a coil spring 84 to connect the pushrod 68 and the plunger 78. The amount of lost motion between the pin 70 and the slot 76 position of the support member 30 relative to the shell 32 are established such that during the second half of the forward stroke of the lever stem 40*d* toward the plunger 78 when the lever is slowing down, the plunger is able to move by its momentum through the lost-motion and strike the shell. Upon striking the shell the plunger is mechanically uncoupled from the lever, and the rest mass striking the shell is minimized. After striking the shell, the natural rebound of the plunger 78 causes it to move instantaneously away from the shell and through the lost-motion. To minimize dampening of the shell by the plunger when the motor and drive are stopped, it is preferable to mount the motor bell of FIGS. 8 and 9 with the plunger extending vertically or near vertically up so that the force of gravity acting on the plunger 78 will keep it from coming to rest against the shell. As in the first embodiment, the plunger 78 enjoys an instantaneous full, natural rebound from the shell 32. The lost motion of the plunger afforded by slot 76 ensures a clear and loud ringing sound.

Figure 10:
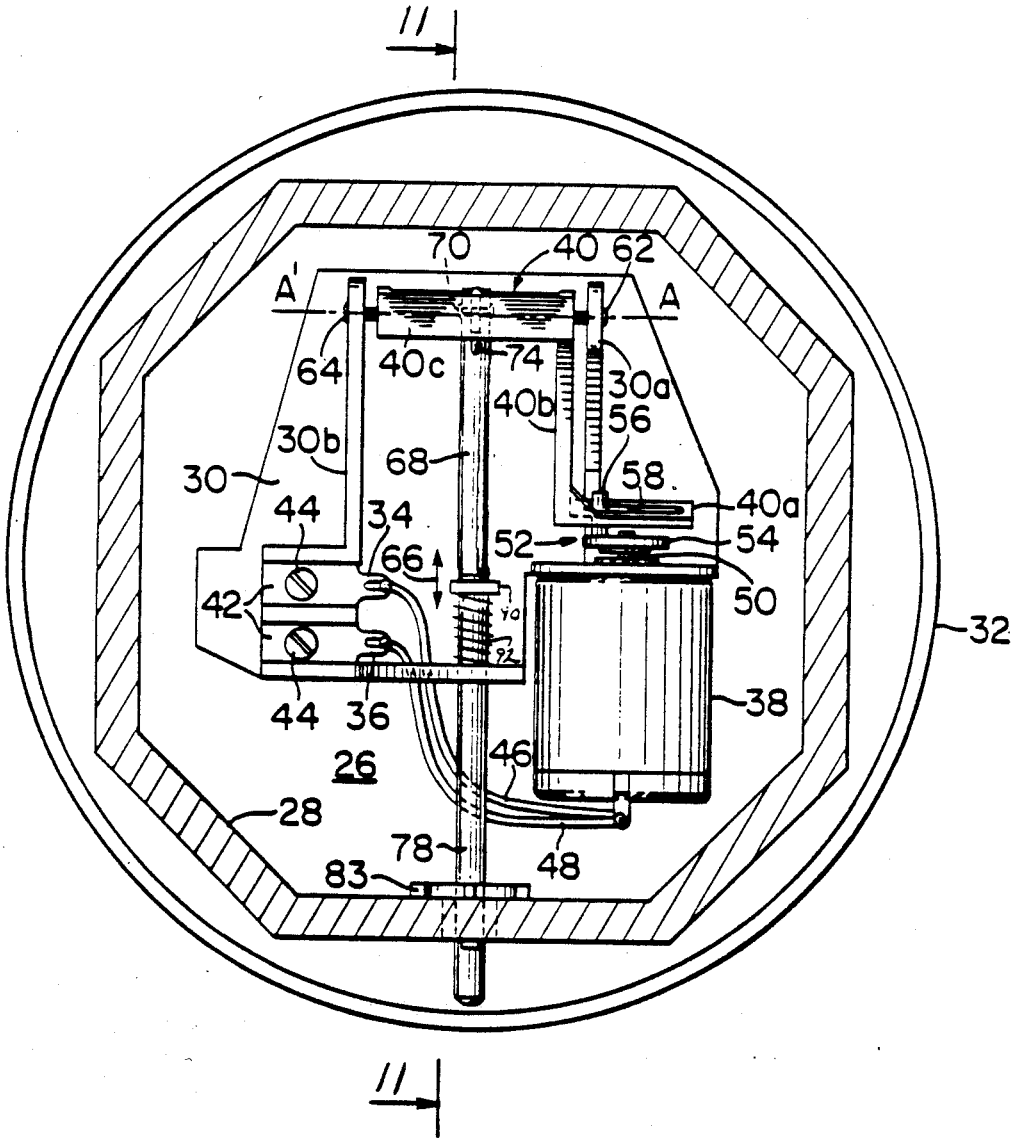
FIG. 10 is a plan view of a third embodiment of the invention.
Figure 11:
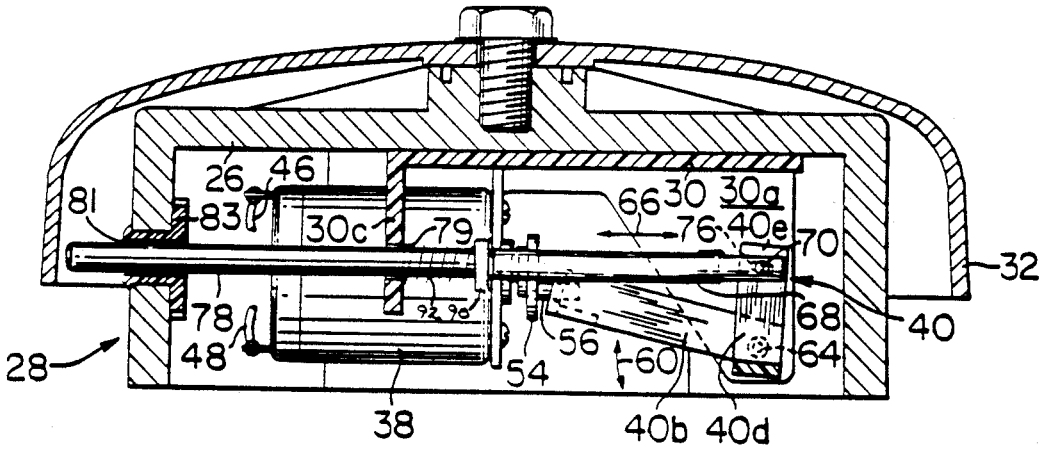
FIG. 11 is a sectional view of the embodiment of FIG. 10, taken along the line 11—11 in FIG. 10 and looking in the direction of the arrows.

In a third embodiment, as shown in FIGS. 10 and 11, the plunger 78 has a shoulder 90 at the end connected to the pushrod 68. The shoulder 90 has a larger diameter than the plunger 78. A rebound compression spring 92 concentrically surrounds the portion of the plunger 78 extending from the upstanding part 30*c* of the support member 30 to the shoulder 90 of the plunger 78. As the plunger 78 moves towards the shell 32, the rebound spring 92 is compressed between the upstanding part 30*c* of the support member 30 and the shoulder 90. When the plunger 78 has reached its apex and strikes the shell 32, the natural rebound and the force of the rebound spring 92 urge the plunger 78 instantaneously away from the shell 32, thereby minimizing the time in which the plunger 78 and the shell 32 are in contact. The embodiment of FIGS. 10 and 11 can, advantageously, be mounted with the plunger extending vertically or near vertically downward; the compression spring 92 keeps the plunger from coming to rest against the shell and dampening the sound when the motor drive stops. As in the embodiment of FIGS. 8 and 9, the embodiment of FIGS. 10 and 11 has a lost-motion between the plunger and the lever such that the plunger can strike the shell by moving through the lost motion relative to the lever 40 during the second one-half of the forward (ringing) stroke of the lever under the momentum imparted to it during the first one-half of the forward stroke of the lever.

Although the invention has been illustrated and described herein by reference to embodiments thereof, it will be understood by those skilled in the art that such embodiments are susceptible of modification and variation without departing from the inventive concepts disclosed. All such modifications and variations, therefore, are intended to the encompassed within the spirit and scope of the invention, as set forth in the appended claims.

I claim:

1. In a motor bell alarm for generating a clear ringing sound having an electric motor for generating a rotational motion, a shell, a plunger for striking said shell, said plunger being positioned such that there is a space between said shell and the end of said plunger adjacent said shell when said plunger is in the at-rest position, and linkage means, having a lever arm, for translating the rotational motion of said electric motor to a longitudinal oscillating motion of said plunger, the improvement wherein said linkage means comprises:

a pushrod, connected at one end to said lever arm and bearing at the other end against said plunger when said plunger is in the at-rest position, for transmitting the oscillating motion of said lever arm to said plunger to cause said plunger to move from the at-rest position towards said shell;

means for connecting said one end of said pushrod to said lever arm so as to provide longitudinal freedom of movement of the pushrod relative to the lever arm in the direction away from the shell when the plunger rebounds from striking the shell; and a tension coil spring concentrically surrounding said pushrod for returning said plunger to its at-rest position after said plunger has rebounded from striking said shell, one end of said spring being connected to the pushrod and the other end of said spring being connected to said plunger, said spring being sufficiently resilient to permit the plunger to move towards the shell, under the momentum imparted thereto by said lever arm and said pushrod, out of bearing engagement with said other end of said pushrod to strike said shell, such that a gap exists between said plunger and said other end of said pushrod when said pushrod strikes said shell.

2. The improvement according to claim 1, wherein said pushrod is connected to said lever arm by a pin inserted through a hole in said lever arm and secured to said pushrod, the diameter of said pin being smaller than the diameter of said hole so as to provide longitudinal freedom of movement of the pushrod.

3. The improvement according to claim 2, wherein said pushrod has a slotted end for inserting an end of said lever arm through which said pin can link said pushrod to said lever arm, said slotted end being sufficiently long so as to provide longitudinal freedom of movement of the pushrod for the range of longitudinal motion provided by the difference in diameter between said pin and said hole in said lever arm.

4. The improvement according to claim 1, wherein said pushrod is constructed of a material substantially less dense than the material of the plunger so as to minimize the mass of said pushrod.

5. In a motor bell alarm for generating a clear ringing sound having an electric motor for generating a rotational motion, a shell, a plunger for striking said shell, said plunger being positioned such that there is a space between said shell and the adjacent end of said plunger when said plunger is in the at-rest position, and linkage means, having a lever arm, for translating the rotational motion of said electric motor to a longitudinal oscillating motion of said plunger, the improvement wherein said linkage means comprises:

a pushrod interposed between the lever arm and the plunger for transmitting the oscillating motion of said lever arm to said plunger to cause said plunger to move from the at-rest position towards said shell;

means including a lost-motion coupling for connecting one end of said pushrod to said lever arm so as to provide longitudinal freedom of movement of the pushrod in the direction away from the shell when the plunger rebounds from striking the shell; and means for connecting the other end of said pushrod to said plunger.

6. The improvement according to claim 5, wherein said pushrod is connected to said lever arm by a pin inserted through a hole in said lever arm and secured to said pushrod, the diameter of said pin being smaller than the diameter of said hole so as to provide longitudinal freedom of movement of the pushrod.

7. The improvement according to claim 6, wherein said pushrod has a slotted end for inserting an end of said lever arm through which said pin can link said pushrod to said lever arm, said slotted end being sufficiently long so as to provide longitudinal freedom of movement of the pushrod for the range of longitudinal motion provided by the difference in diameter between said pin and said hole in said lever arm.

8. The improvement according to claim 5, wherein said pushrod is constructed of a material substantially less dense than the material of the plunger so as to minimize the mass of said pushrod.

9. The improvement according to claim 5 and further comprising:

a support member for guiding the movement of said plunger; and a rebound spring concentrically surrounding a portion of said plunger and compressed between said support member and a shoulder on the said plunger for urging said plunger away from said shell so as to prevent said plunger from coming to rest against said shell and dampening the ringing sound when said motor stops.

10. The improvement according to claim 5 wherein said plunger is oriented substantially vertically upwardly so that the force of gravity acting on said plunger prevents said plunger from coming to rest against said shell and dampening the ringing sound when said motor stops.

* * * * *